US012480387B2

(12) United States Patent
Koon

(10) Patent No.: US 12,480,387 B2
(45) Date of Patent: Nov. 25, 2025

(54) METHODS AND DEVICES FOR ORIENTING PERFORATED GUNS

(71) Applicant: Steel Dog Industries Inc., Charleroi, PA (US)

(72) Inventor: Jason R. Koon, Charleroi, PA (US)

(73) Assignee: Steel Dog Industries Inc., Charleroi, PA (US)

( * ) Notice: Subject to any disclaimer, the term of this patent is extended or adjusted under 35 U.S.C. 154(b) by 571 days.

(21) Appl. No.: 17/708,521

(22) Filed: Mar. 30, 2022

(65) Prior Publication Data

US 2024/0410259 A1 Dec. 12, 2024

Related U.S. Application Data

(60) Provisional application No. 63/187,512, filed on May 12, 2021.

(51) Int. Cl.

| | |
|---|---|
| ***E21B 43/116*** | (2006.01) |
| ***E21B 43/117*** | (2006.01) |
| ***E21B 43/119*** | (2006.01) |
| *E21B 43/1185* | (2006.01) |

(52) U.S. Cl.
CPC ..... *E21B 43/116* (2013.01); *E21B 43/117* (2013.01); *E21B 43/119* (2013.01); *E21B 43/1185* (2013.01)

(58) Field of Classification Search
CPC .... E21B 43/116; E21B 43/119; E21B 43/117; E21B 43/1185; E21B 43/11
See application file for complete search history.

(56) References Cited

U.S. PATENT DOCUMENTS

| | | | | |
|---|---|---|---|---|
| 10,914,145 | B2 * | 2/2021 | Sullivan | E21B 43/1185 |
| 11,339,614 | B2 * | 5/2022 | Mulhern | E21B 17/028 |
| 2013/0126237 | A1 * | 5/2013 | Burton | E21B 43/1185 175/2 |
| 2020/0256168 | A1 * | 8/2020 | Knight | E21B 43/119 |

* cited by examiner

*Primary Examiner* — Yong-Suk (Philip) Ro
(74) *Attorney, Agent, or Firm* — Lippes Mathias LLP

(57) ABSTRACT

Methods and devices for orienting multiple gun barrels in desired directions and configurations have the locking threads of the gun barrels and the sub bodies placed in specified locations. Thus, when the sub body and the two gun barrels are joined to each other, the scallops of the two gun barrels will be aligned with each other.

8 Claims, 9 Drawing Sheets

METHODS AND DEVICES FOR ORIENTING PERFORATED GUNS

CROSS-REFERENCE TO RELATED APPLICATIONS

This application claims priority to U.S. Provisional Patent Application Ser. No. 63/187,512, filed on May 12, 2021, which is incorporated by reference in its entirety.

BACKGROUND

The present disclosure relates to methods and devices for orienting perforating guns in desired configurations. Such devices include gun barrels and sub bodies with locking threads in specified locations.

Various activities, such as oil or gas or water exploration and production, involve drilling and completing a wellbore. The wellbore is drilled into the ground and lined with a casing. The casing may also be cemented in place. To create flow paths between the wellbore and the formation, a perforating gun is used. Perforating guns are tubular-shaped devices having an outer housing that holds one or more interconnected gun barrels. The gun barrel holds multiple shaped explosive charges ("shots") positioned about the circumference thereof and aimed in a radial direction. A perforating gun may incorporate multiple gun barrels, which are separated by a sub body. When detonated, the shaped charges create perforations through the wellbore casing/cement and into the earthen formation.

BRIEF DESCRIPTION

Disclosed in the present disclosure are methods and devices for orienting multiple gun barrels in desired directions and configurations. Briefly, those methods include placing the locking threads of the gun barrels and the sub bodies in specified locations. This causes the shots to be oriented/aligned in desired directions.

Generally, the sub body is machined so that the starting ends of the two threads thereon are each located at 0° or at 180° relative to a longitudinal axis of the sub body. Put another way, when using a plan view of the sub body (i.e. along its longitudinal axis, the plan view angle defined by the starting end of the first thread, the starting end of the second thread, and the center of the sub body is either 0° or 180°. The two gun barrels are also machined so that the starting ends of the two threads thereon are each located at 0° or at 180° (relative to each other or to the phasing of the scallops thereon). Thus, when the sub body and the two gun barrels are joined to each other, the scallops of the two gun barrels will be aligned with each other.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 5A is a perspective view. FIG. 5B is a side view. FIG. 5C is a side cross-sectional view.

FIG. 5D is a perspective view. FIG. 5E is a side view. FIG. 5F is a side cross-sectional view.

DETAILED DESCRIPTION

Figure 1:
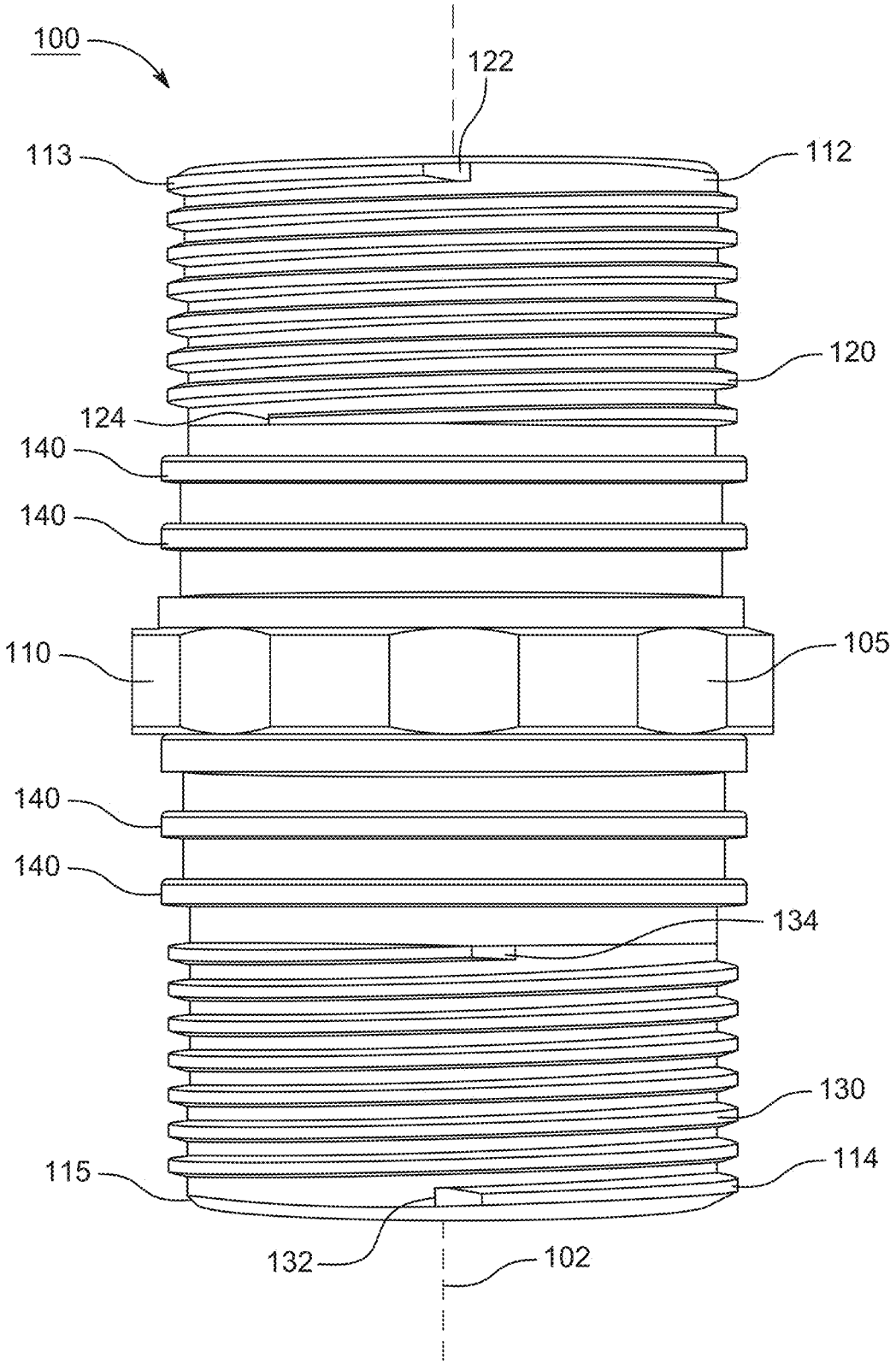
FIG. 1 is an exterior side view of a sub body of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named components/ingredients/steps and permit the presence of other components/ingredients/steps. However, such description should be construed as also describing systems or devices or compositions or processes as "consisting of" and "consisting essentially of" the enumerated components/ingredients/steps, which allows the presence of only the named components/ingredients/steps, along with any unavoidable impurities that might result therefrom, and excludes other components/ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

It should be noted that many of the terms used herein are relative terms. For example, the terms "upper" and "lower" are relative to each other in location, i.e. an upper component is located at a higher elevation than a lower component in a given orientation. The terms "top" and "bottom" or "base" are also relative to each other, as are the terms "upward" and "downward". Some of the components described herein can be inverted, so that such relative terms are appropriate.

The terms "horizontal" and "vertical" are used to indicate direction relative to an absolute reference, i.e. ground level. However, these terms should not be construed to require structures to be absolutely parallel or absolutely perpendicular to each other.

The present disclosure relates to methods for orienting perforating guns and various components used therewith. In particular, these components are particularly useful for transmitting electrical signals using a pin-to-pin system. The methods and devices of the present disclosure are first described, and then conventional devices are described for comparative purposes. It is noted that these methods and devices can be applied to port plug guns, scalloped guns, and slick walled guns as well, although the discussion herein will refer only to scalloped guns.

Figure 2:
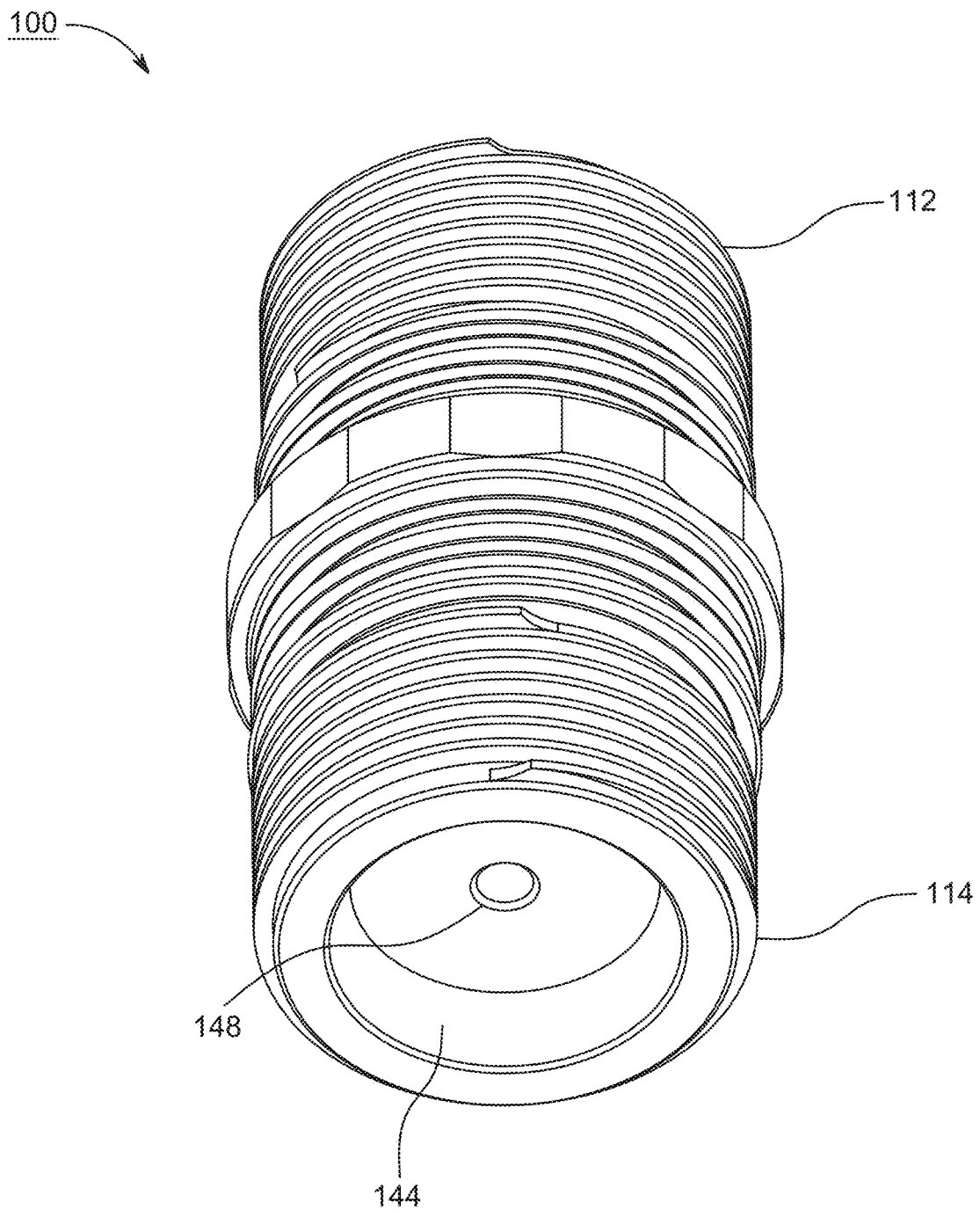
FIG. 2 is a perspective view of the sub body of FIG. 1.
Figure 3B:
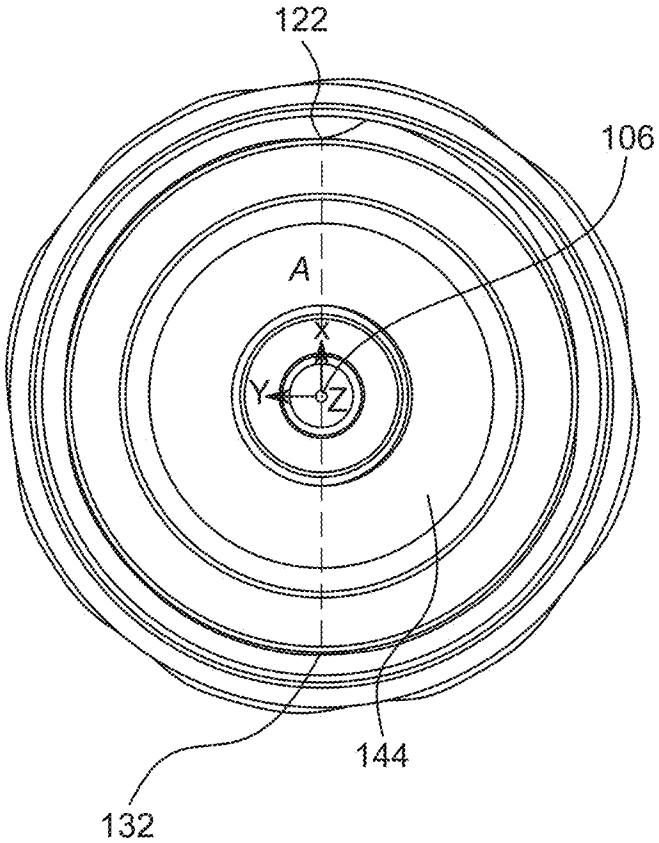
FIG. 3B is a plan view of a second sub body, with the starting end of one external thread at 0° and the other external thread at 180°.
Figure 3A:
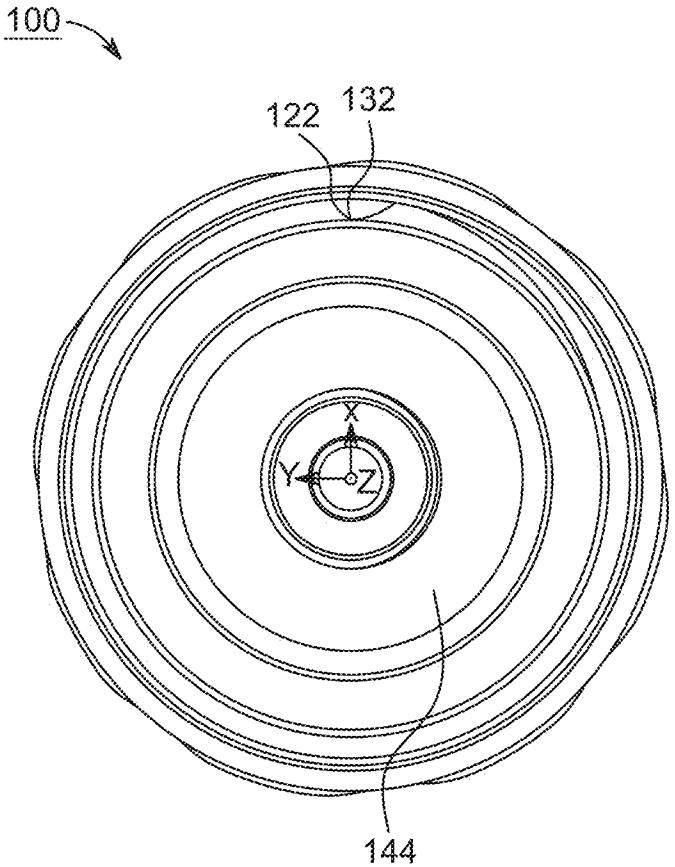
FIG. 3A is a plan view of a first sub body, with the starting ends of both external threads at 0°.

FIG. 1 is an exterior side view of a sub body of the present disclosure. FIG. 2 is a perspective view of the sub body, with one end visible. FIG. 3A and FIG. 3B are plan views of two different sub bodies.

Referring first to FIG. 1, the sub body 100 comprises a main body 110 having a first end 112 and a second end 114. The sub body can be considered generally cylindrical, having a central longitudinal axis 102. A first external thread 120 is present on the outer surface of the main body at the first end. A second external thread 130 is present on the outer surface of the main body at the first end. A central shoulder 105 of the outer surface of the main body 110 is located between the first thread 120 and the second thread 130. The central shoulder can be knurled or otherwise textured to improve grip, and may be shaped to improve contact with a tool (e.g. a wrench).

The first thread 120 has a starting end 122 and a stop end 124. The second thread 130 also has a starting end 132 and a stop end 134. As seen in the side view, each thread starting end 122, 132 is located at an end plane 113, 115 of the main body. Each thread stop end 124, 134 is located closer to the shoulder 105 than the thread starting end 122, 132. Two ridges 140 are also present on each side of the shoulder 105.

Referring now to FIG. 2, each end 112, 114 also includes a box which can be described as an indented area into which an end cap can be inserted. Here, only the box 144 on the second end 114 is visible. A port 148 is also present in the box 144, through which a pin can extend or be accessed, as explained further herein.

FIG. 3A is a plan view of a first sub body 100 looking into the box 144 along the longitudinal axis. The location of the first thread starting end 122 can be arbitrarily defined as being located at 0° about the circumference of the sub body. Considering FIG. 1 and FIG. 3A together, it can be seen that the second thread starting end 132 is also located at 0°.

In FIG. 3B, the first thread starting end 122 is located at 0°, and the second thread starting end 132 is located at 180°. Put another way, a plan view angle A can be defined by the first thread starting end 122, the second thread starting end 132, and the center 106 of the sub body. In particular embodiments, this plan view angle is 0 degrees or 180 degrees. The plan view angle should always be the smaller angle defined by these three points, and cannot be greater than 180°.

Figure 4:
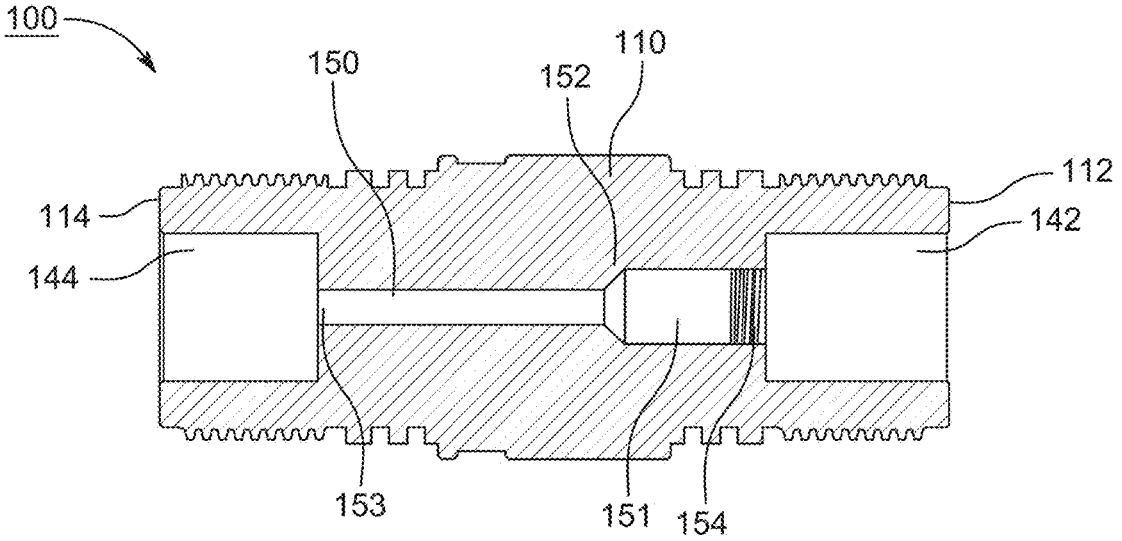
FIG. 4 is a cross-sectional view of a sub body according to the present disclosure that uses a "pin-to-pin" connection.

FIG. 4 is a cross-sectional view of the sub body, illustrating the internal components. A shaft 150 extends entirely through the main body 110 from the first end 112 to the second end 114. Boxes 142, 144 are present at each end. However, the shaft 150 has a larger diameter 151 near the first end 112, and a narrower or smaller diameter 153 at the second end 114, forming a stop surface 152 within the shaft 150. Thus, only one nut (not illustrated) is needed to fix the electrically-conductive through-pin in place via internal thread 154.

Figure 5A:
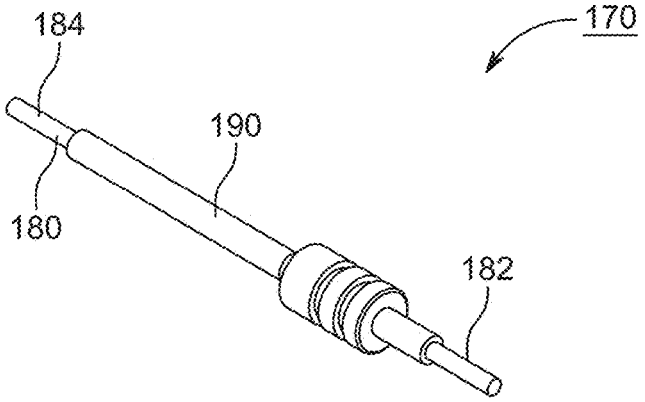
FIGS. 5A-5C are various views of a first structure for an electrically-conductive through-pin located within the pin-to-pin sub body.
Figure 5B:
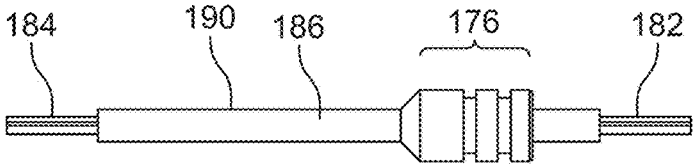
Figure 5C:
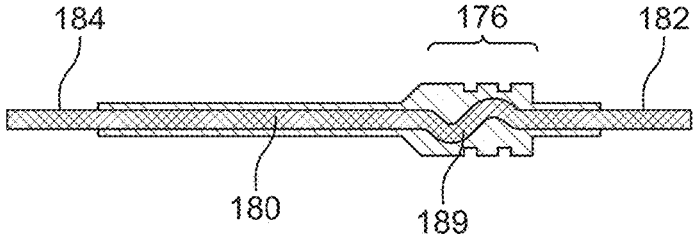

FIGS. 5A-5C show a first structure for the electrically-conductive through-pin 170 which is inserted into the shaft 150 of the tandem sub. FIG. 5A is a perspective view. FIG. 5B is a side view. FIG. 5C is a side cross-sectional view.

Referring first to FIG. 5A and FIG. 5B, the through-pin 170 is formed from an electrically-conductive rod 180 and an non-electrically conductive jacket 190.

The rod 180 is in the form of a solid wire, and is made of an electrically conductive material (e.g. metal). The rod has a first end 182 and a second end 184 visible at opposite ends of the rod. A non-electrically conductive jacket 190 surrounds the central portion 186 of the rod itself, with the two ends 182, 184 of the rod remaining exposed. The through-pin itself has only one shoulder 176 located relatively close to the first end 182 of the rod (i.e. not in the center of the through-pin). The shoulder has a greater diameter than the rest of the through-pin.

Referring now to FIG. 5C, it can be seen that the wire of the rod 180 is bent in a location 189 corresponding to the shoulder 176, to have a larger diameter. The bend can be two-dimensional (i.e. within a plane) or three-dimensional (e.g. a small helix). Otherwise, the solid wire is straight. This bend enhances physical joinder of the rod 180 to the jacket 190.

Figure 5D:
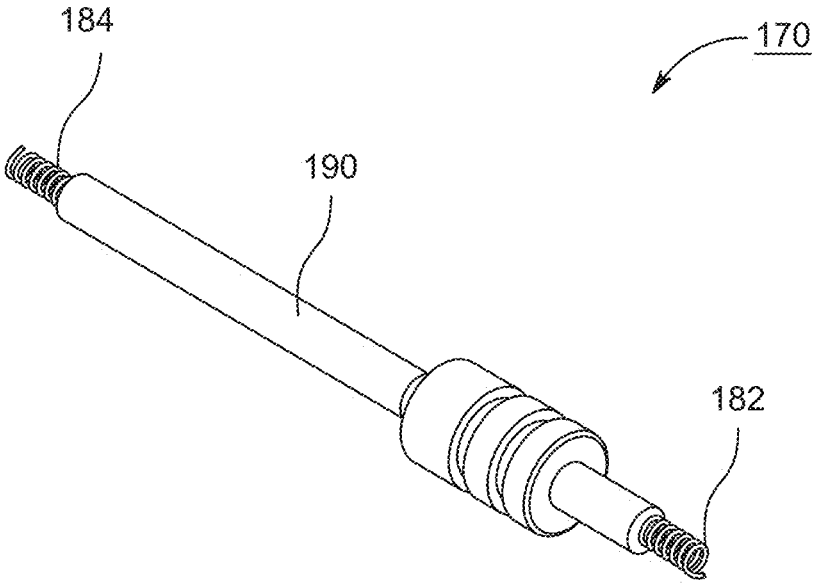
FIGS. 5D-5F are various views of a second structure for an electrically-conductive through-pin located within the pin-to-pin sub body.
Figure 5E:
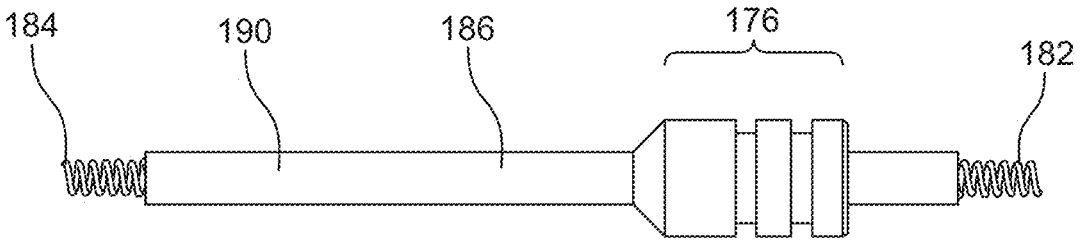
Figure 5F:
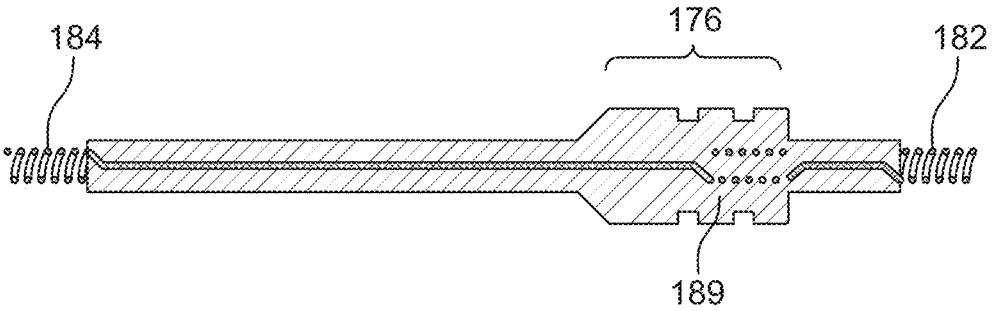

FIGS. 5D-5F show a second structure for the electrically-conductive through-pin 170 located within the sub body. FIG. 5D is a perspective view. FIG. 5E is a side view. FIG. 5F is a side cross-sectional view.

Referring first to FIG. 5D and FIG. 5E, the rod 180 is made from a relatively thinner wire than that shown in FIG. 5A. The rod has a first end 182 and a second end 184 visible at opposite ends of the rod. At each end, the wire has been coiled, so that these ends are in the form of a spring. A non-electrically conductive jacket 190 surrounds the central portion 186 of the wire itself, with the two ends 182, 184 of the rod remaining exposed. The through-pin again has only one shoulder 176 located relatively close to the first end 182 of the rod (i.e. not in the center of the through-pin). The shoulder has a greater diameter than the rest of the through-pin.

Referring now to FIG. 5F, it can be seen that the wire of the rod 180 is also coiled into the form of a spring at a location 189 corresponding to the shoulder 176, to have a larger diameter. This is an example of the bend having a three-dimensional form. The remainder of the wire is straight beyond these three coiled locations.

Referring back to FIG. 4, the through-pins of FIG. 5A and FIG. 5D are inserted into the shaft 150 from the first end 112. The thinner part of the through-pin 170 passes through to the second end 114. The shoulder 176 contacts the stop surface 152, to stop the travel of the through-pin towards the second end. A single nut (not illustrated) also engages the shoulder 176 and thread 154, to hold the through-pin 170 in the shaft 150.

Figure 6:
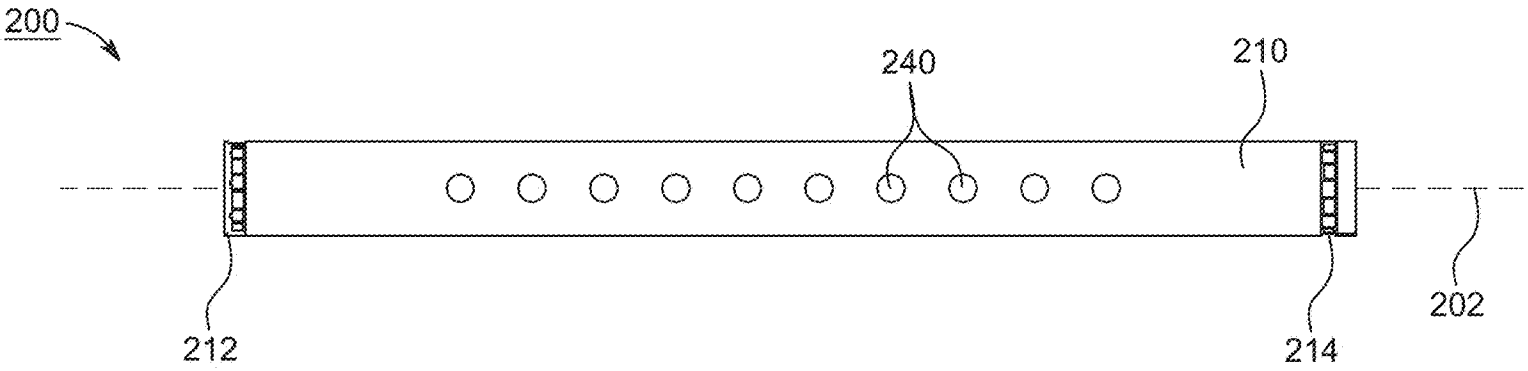
FIG. 6 is an exterior side view of a gun barrel of the present disclosure.
Figure 7:
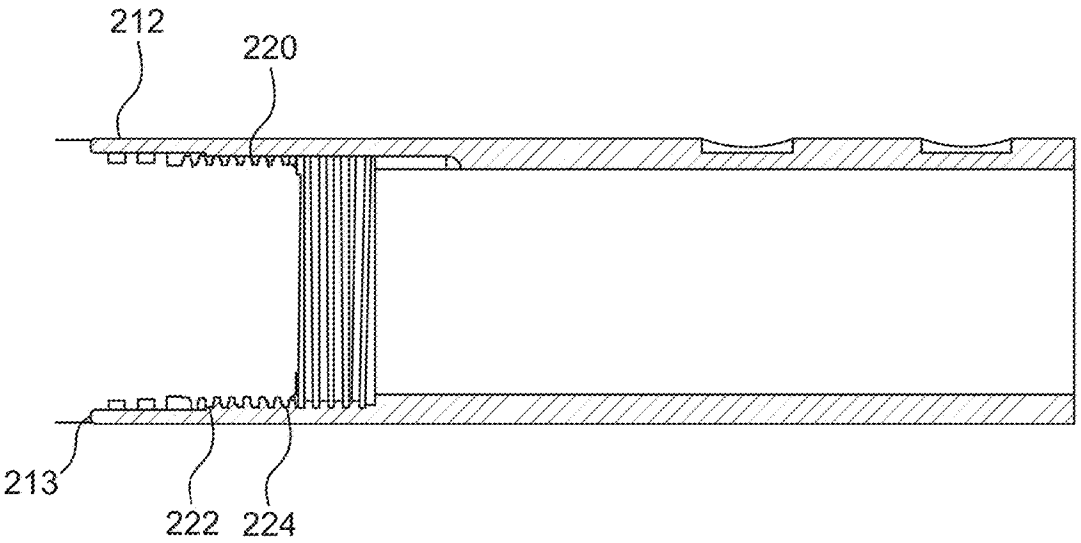
FIG. 7 is an exterior side view of a gun barrel of the present disclosure.
Figures 8A, 8B:
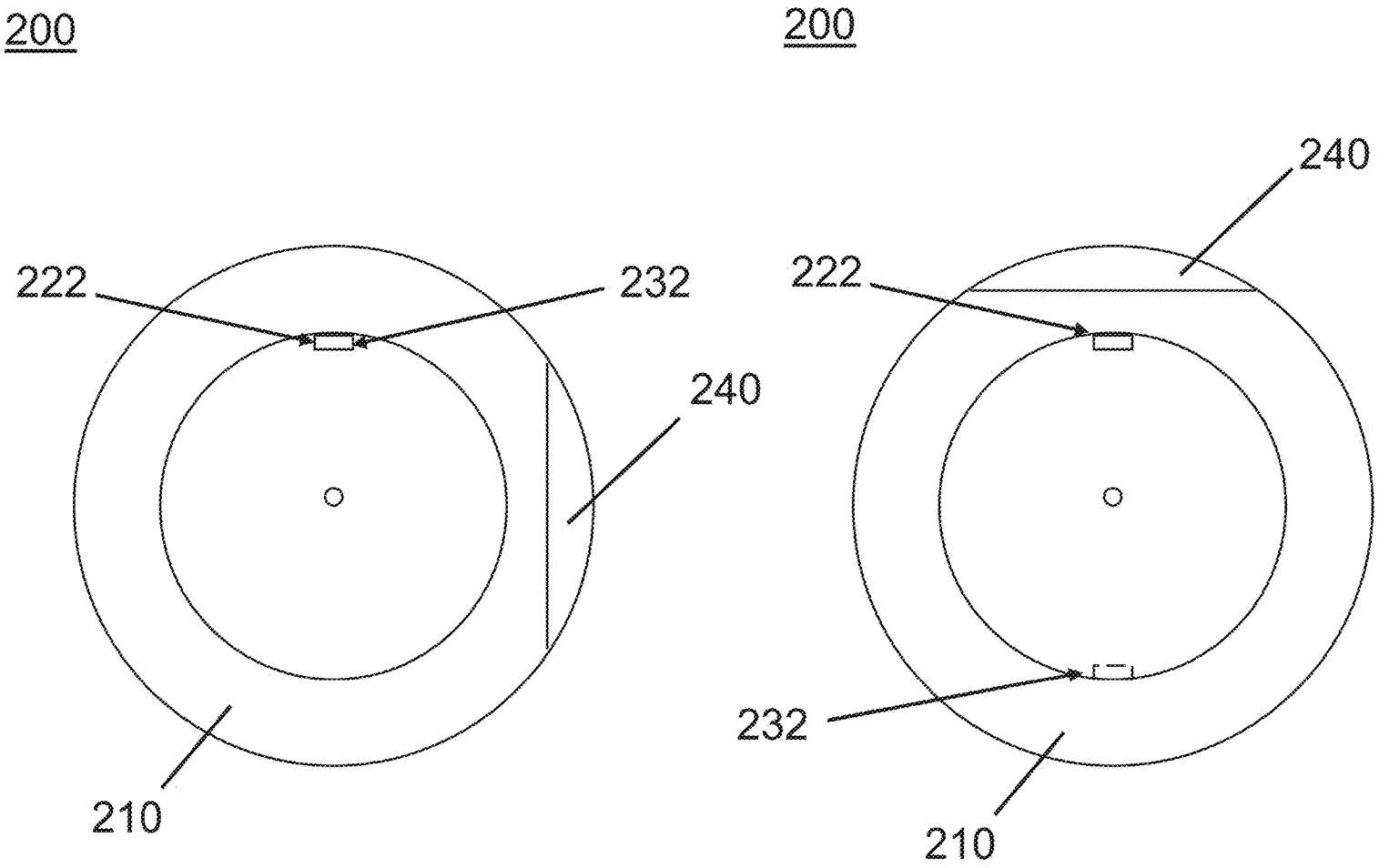
FIG. 8A is a plan view of a first gun barrel, with the starting ends of both internal threads at 0°.
FIG. 8B is a plan view of a second gun barrel, with the starting end of one internal thread at 0° and the other internal thread at 180°.

Continuing, FIGS. 6-8 show various aspects of a gun barrel of the present disclosure, which is used together with the sub body. FIG. 6 is an exterior side view of the gun barrel. FIG. 7 is a magnified side cross-sectional of one end of the gun barrel. FIG. 8A and FIG. 8B are plan cross-sectional views of two different gun barrels.

Referring first to FIG. 6, the gun barrel 200 comprises a cylindrical sidewall 210 and has a first end 212 and a second end 214. The gun barrel has a central longitudinal axis 202. Scallops or ports 240 are present along the length of the sidewall. These scallops provide an exit point for the explosive charges ("shots").

Moving now to FIG. 7, the first end 212 of the gun barrel is shown. A first internal thread 220 is present on the inner surface of the sidewall at the first end. The first thread 220 has a starting end 222 and a stop end 224. The thread starting end 222 is located closer to an end plane 213 than the stop end 224. Although not illustrated, a second internal thread at the opposite second end is also present, and has the same properties as described above.

Referring now to FIG. 8A and FIG. 8B, gun barrels are typically described in terms of the phasing of the scallops, i.e. the radial distribution of successive scallops around the gun axis as one moves down the length of the barrel. For example, in a gun barrel with 90-degree phasing, the scallops will be rotated 90° relative to each other, and the resulting gun barrel will have explosive charges that shoot in four directions radially. The most common oriented gun barrel has 0-degree phasing, i.e. all of the scallops face in the same direction, 0°. The next most common oriented gun barrel has 180-degree phasing, i.e. the scallops face in only two opposite directions, 0° and 180°. The gun barrels of the present disclosure preferably have 0-degree phasing or 180-degree phasing.

FIG. 8A is a plan view of the gun barrel 200 looking along the longitudinal axis. This gun barrel is illustrated with 0-degree phasing, as indicated by scallop 240. The location of the first thread starting end 222 can be arbitrarily defined as being located at 0° about the circumference of the gun barrel. In FIG. 8A, a starting end 232 of the second thread is also located at 0°. In FIG. 8B, the first thread starting end 222 is located at 0°, and the second thread starting end 232 is located at 180°.

Figure 9:
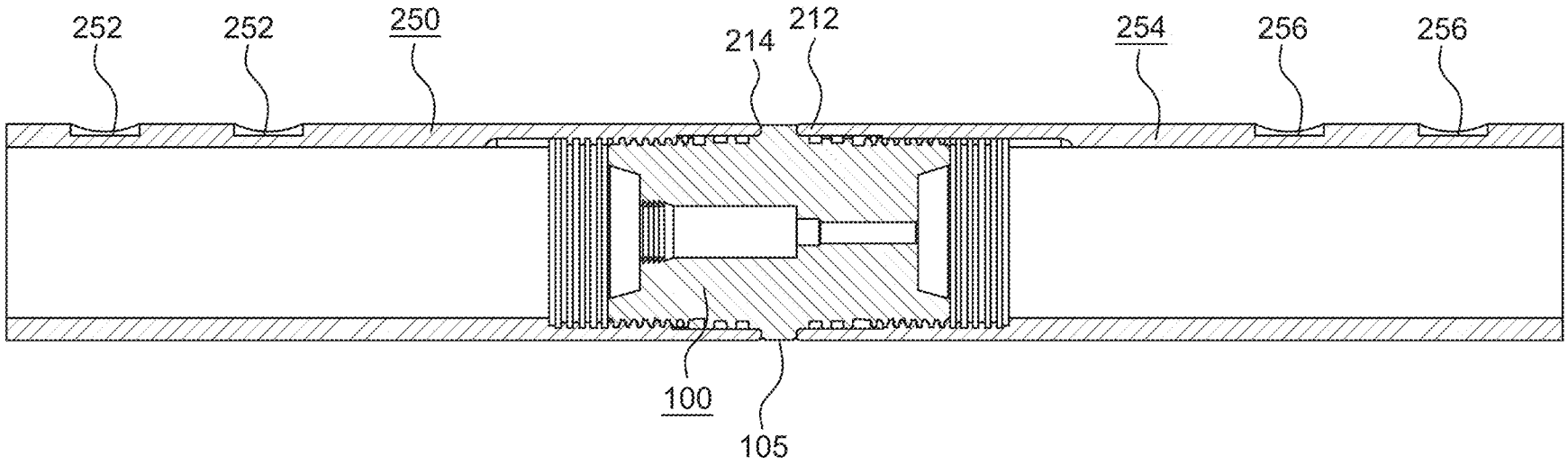
FIG. 9 is a cross-sectional view of a perforating gun assembly formed from a sub body and two gun barrels.

By defining where the threads start on the sub body and the gun barrels, the locations of the scallops on two adjacent gun barrels can be aligned with each other. As a result, the scallops of consecutive gun barrels can all be in a straight line. This is illustrated in FIG. 9, which is a cross-sectional view of a perforating gun assembly formed from a sub body 100 and two gun barrels 250, 254. Here, the two gun barrels have 0-degree phasing. As seen here, the scallops 252, 256 of the two gun barrels are aligned, and face in the same direction. It should also be noted that the ends 212, 214 of both gun barrels abut the central shoulder 105. Put another way, the scallops 252, 256 are aligned, or in a straight line. More generally, any number of sub bodies and gun barrels can be strung together to form a downhole string with the scallops in a straight line.

It is noted that the 0° of the gun barrel defined by the first thread starting end 222 does not have to correspond to the 0-degree defined by the location of the scallops. However, it may be desirable that the 0° of the first thread starting end is the same as the 0-degree location of the scallops. In FIG. 8B, both the first thread starting end 222 and the scallops 240 are located at the same 0° location. In FIG. 8A, the 0° location is offset from the 0-degree location of the scallops by 90°.

The sub bodies and gun barrels of the present disclosure can be made using conventional manufacturing techniques, with appropriate care being applied to ensure the starting ends of the threads on each end are placed in their desired relative location. Machines such as mills/lathes/dies can be used.

Figure 10:
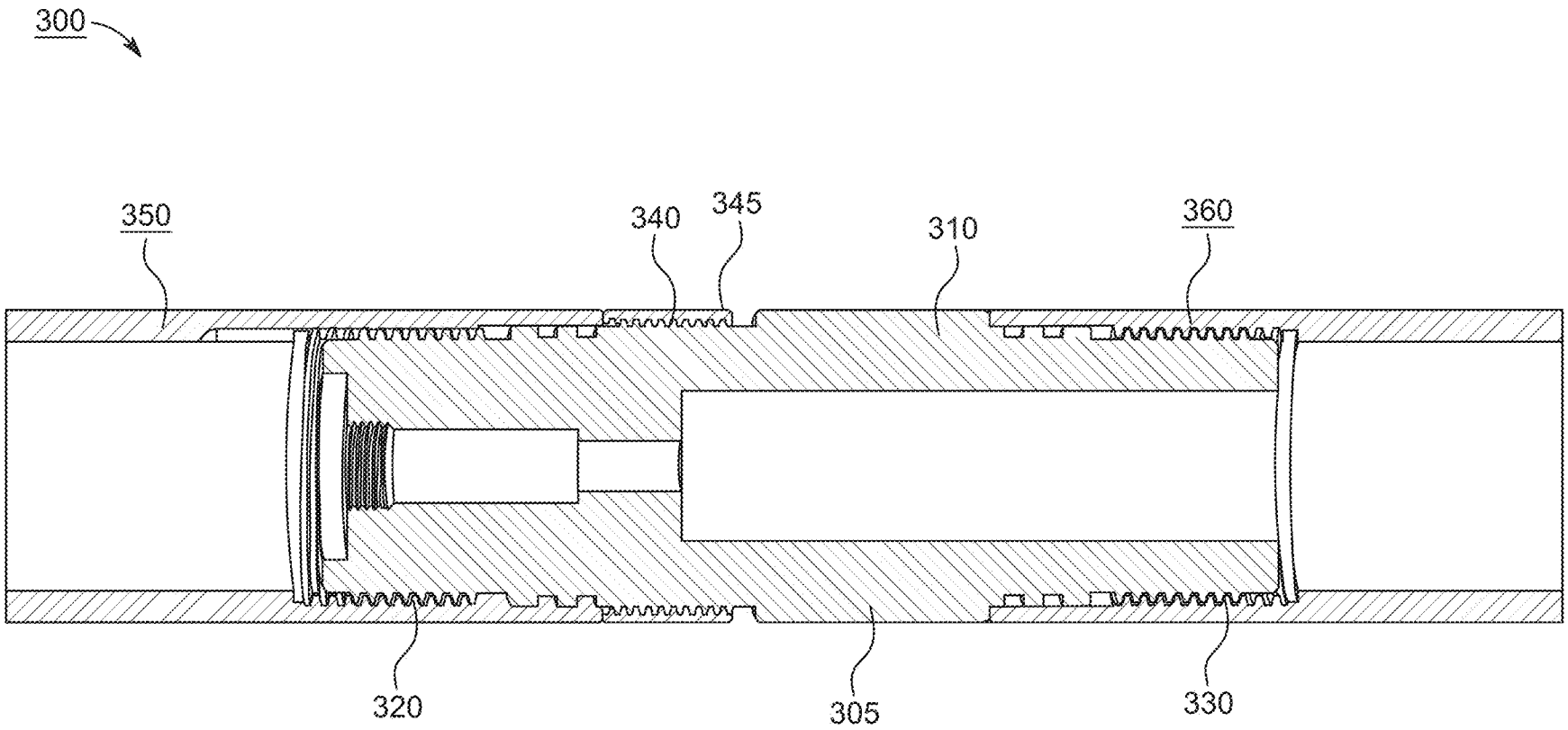
FIG. 10 is a side cross-sectional view of a conventional sub body with a lock-ring.

The advantages of the sub bodies and gun barrels of the present disclosure can be better understood by comparison to conventional components. In this regard, FIG. 10 illustrates a sub body 300. The sub body includes a main body 310 having a first external thread 320 and a second external thread 330 at opposite ends thereof. A shoulder 305 is located between the two threads 320, 330. In addition, a third external thread 340 is located between the shoulder 305 and the first thread 320. Two gun barrels 350, 360 are shown screwed onto the sub body 300. Gun barrel 360 abuts the shoulder 305. Traditionally, the ends of the threads are located randomly on the exterior surface of the sub body. if the scallops of adjacent gun barrels were not aligned when attached to the sub body, one of the barrels would be unscrewed until the scallops were aligned. This is illustrated here, with gun barrel 350 being partially unscrewed. Lock ring 345 is mounted upon the third external thread 340, and acts as a shoulder/stop surface for gun barrel 350, and prevents further movement.

This method of alignment was previously acceptable when electrical signals were transmitted between gun barrels using wires whose length could be extended as needed. However, this method of aligning gun barrels by unscrewing one barrel may not be compatible with pin-to-pin connections, where the electrical contacts have limited travel (see FIGS. 5A-5F). the industry standard uses six threads-per-inch (6 TPI). Unscrewing a gun barrel just one rotation thus equals an additional length of 0.167 inch or 0.42 cm that must be traveled by the electrical contact, which could break the electrical connection between the sub body and the gun barrel. Besides resulting in a non-functional gun barrel, this can cause safety concerns in trying to retrieve the non-fired explosive charges/shots.

Using the methods and components of the present disclosure, the scallops of adjacent gun barrels can be aligned with each other when screwed completely onto the sub body (i.e. the ends of both gun barrels will abut the shoulder of the sub body). This simplifies the alignment process in the field. It also reduces the overall cost of manufacturing by removing the need for lock rings or special sub bodies to obtain alignment. These methods can also be used for other downhole tools that require axial alignment.

It is also noted that because the presence of a lock ring is not needed, the sub bodies of the present disclosure can have a shorter length than that of conventional sub bodies. As a result, the length of the overall gun string can also be reduced.

Additional aspects of the present disclosure are contemplated. In some embodiments, the sub bodies of the present disclosure do not include a lock ring. In some embodiments, however, the sub bodies may include a third external thread on the central shoulder. This thread can be used to support a stand-off ring, which maintains a stand-off distance between the sub body (and its downhole string) and the casing.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A method for orienting shots in adjacent gun barrels in the same direction, comprising:

receiving a sub body having a first thread and a second thread at opposite ends thereof, wherein a plan view angle defined by a starting end of the first thread, a starting end of the second thread, and a center of the sub body is either 0° or 180°;

attaching a first gun barrel to the sub body via the first thread; and attaching a second gun barrel to the sub body via the second thread;

wherein the first gun barrel and the second gun barrel each include scallops located at only 0° along a length of the first gun barrel and a length of the second gun barrel.

2. The method of claim 1, wherein the first gun barrel includes a first thread and a second thread at opposite ends thereof, and wherein a starting end of the first thread and a starting end of the second thread are each located at 0° or at 180°.

3. The method of claim 1, wherein the sub body includes a shaft extending between the opposite ends thereof, and the sub body further comprises an electrically conductive rod fixed in place within the shaft, the ends of the rod exposed at the first end and the second end of the body for forming a pin-to-pin electrical connection.

4. The method of claim 1, wherein the sub body further comprises a central shoulder which provides a stop for both the first gun barrel and the second gun barrel.

5. The method of claim 4, wherein the sub body further comprises a third thread located between the central shoulder and the first thread.

6. The method of claim 5, further comprising a stand-off ring attached to the third thread.

7. The method of claim 1, wherein the sub body does not contain a third thread, or wherein the sub body does not include a lock ring.

8. A perforating gun assembly, comprising a sub body, a first gun barrel, and a second gun barrel:

wherein the sub body comprises a first end with a first thread thereon and a second end with a second thread thereon, and wherein a plan view angle defined by a starting end of the first thread, a starting end of the second thread, and a center of the sub body is either 0° or 180°; and wherein the first gun barrel and the second gun barrel each includes a first thread and a second thread at opposite ends thereof, and wherein a starting end of the first thread and a starting end of the second thread are each located at 0° or at 180°; and wherein the first gun barrel and the second gun barrel each include scallops located at only 0° along a length of the first gun barrel and a length of the second gun barrel.

* * * * *